US012729054B2

(12) United States Patent
Behrmann

(10) Patent No.: US 12,729,054 B2
(45) Date of Patent: Sep. 8, 2026

(54) CAPSULE FOR PRODUCING A BEVERAGE WITH FILTER DISC

(71) Applicant: SOCIETE DES PRODUITS NESTLE S.A., Vevey (CH)

(72) Inventor: Veith Behrmann, Villeneuve (CH)

(73) Assignee: Societe des Produits Nestle S.A., Vevey (CH)

( * ) Notice: Subject to any disclaimer, the term of this patent is extended or adjusted under 35 U.S.C. 154(b) by 859 days.

(21) Appl. No.: 18/002,538

(22) PCT Filed: Jun. 21, 2021

(86) PCT No.: PCT/EP2021/066766

§ 371 (c)(1),
(2) Date: Dec. 20, 2022

(87) PCT Pub. No.: WO2021/259830

PCT Pub. Date: Dec. 30, 2021

(65) Prior Publication Data

US 2023/0227244 A1 Jul. 20, 2023

(30) Foreign Application Priority Data

Jun. 24, 2020 (EP) ..... 20181874

(51) Int. Cl.
*B65D 85/804* (2006.01)

(52) U.S. Cl.
CPC ..... *B65D 85/8043* (2013.01)

(58) Field of Classification Search
CPC ..... A47J 31/005; A47J 31/02; A47J 31/20; A47J 31/24; A47J 31/30; A47J 31/132; A47J 31/38; A47J 31/44; A47J 31/446; A47J 31/467; A47J 31/468; A47J 31/605; A47J 31/4407; A47J 31/5253; A47J 31/521; A47J 31/3633; B65D 85/8043
USPC ..... 99/280, 281, 282, 283, 284, 287, 292, 99/295, 297, 303, 306, 308, 322
See application file for complete search history.

(56) References Cited

FOREIGN PATENT DOCUMENTS

| | | | | |
|---|---|---|---|---|
| CN | 101500907 | A | 8/2009 | |
| CN | 209492917 | U | 10/2019 | |
| EP | 2442694 | A1 | 4/2012 | |
| EP | 2995577 | | 3/2016 | |
| WO | 2006111807 | | 10/2006 | |
| WO | WO-2006111807 | A1 * | 10/2006 | ..... B65D 85/8043 |
| WO | 2020009577 | | 1/2020 | |

OTHER PUBLICATIONS

Chinese Office Action for Chinese Appl No. 202180040472.8 dated Apr. 3, 2024, 5 pages.

* cited by examiner

*Primary Examiner* — Phuong T Nguyen
(74) *Attorney, Agent, or Firm* — K&L Gates LLP

(57) ABSTRACT

A capsule for producing a beverage using an extractable product, by means of a beverage brewing device includes a cup having a cavity, a foil connected to the flange and closing the cup at the second end, a beverage substance filled in the cavity and a filter disc fitted in the cavity between the beverage substance and the foil.

12 Claims, 5 Drawing Sheets

CAPSULE FOR PRODUCING A BEVERAGE WITH FILTER DISC

CROSS REFERENCE TO RELATED APPLICATIONS

The present application is a National Stage of International Application No. PCT/EP2021/066766, filed on Jun. 21, 2021, which claims priority to European Patent Application No. 20181874.7, filed on Jun. 24, 2020, the entire contents of which are being incorporated herein by reference.

FIELD OF THE INVENTION

The invention relates to a capsule for preparing a beverage suitable for consumption using an extractable product and to a method for producing such capsule.

BACKGROUND

Systems for preparing a beverage, such as coffee using a brewing device for supplying a liquid, such as water, under pressure to a capsule comprising a dose of beverage ingredient (i.e., a beverage substance) are known. The capsule usually comprises a cup-shaped base body provided with a bottom and a side wall for receiving the beverage substance and a flange-like rim. A beverage delivery foil closing the cup is attached to the flange-like rim, said beverage delivery foil is intended to be torn under pressure during the brewing process.

Typically, the brewing device comprises a chamber for receiving the capsule, such as a capsule cage for covering the cup and pressing a flange of the cup against a capsule support of the device comprising extracting means, e.g., recesses and protrusions. As liquid is filled in the capsule, the pressure rises inside and the foil is pressed against the extracting means of the support until the foil breaks at several locations generally at the top edges of pyramid-shaped protrusions, thereby creating small orifices for the beverage to exit the capsule. EP0512470 describes a process of extraction of this kind for a sealed capsule.

WO2006111807A1 relates to improvements to capsules and machines for the making of infuses such as espresso coffee. The capsule, hermetically sealed by a lid, internally includes a distance wheel equipped with a filter paper disc, and the capsule can be used with a closable machine provided with devices for the steam injection and with simple punching devices to allow the pouring out of the infuse, such as espresso coffee, from the capsule. The presence of the filter prevents the coming out of the powders even if very fine.

However, the positioning of the filter paper disc is such that the filter is placed at the highest distance from the lid and the reinforcement is placed between the filter paper and the lid. This configuration provides several problems.

Firstly, the filter paper is submitted to high stress during extraction and is prone to breakage due to the large voids created by the distance wheel.

Secondly, significant volume for the beverage is lost (unutilized) in the capsule due to the voids that can be prejudicial to the quality of the beverage, e.g., the strength and aroma of coffee.

The invention aims at solving the above-identified problem as well as providing convenience in producing the capsule.

For this, the invention relates to a capsule for producing a beverage using an extractable product, by means of a beverage brewing device, comprising:

- a cup comprising a cavity defined by a circumferential wall, a bottom wall closing the circumferential wall at a first end, and an outwardly protruding flange connected to the circumferential wall at a second end opposite the first end in the axial direction of the capsule;
- a foil connected to the flange and closing the cup at the second end,
- a beverage substance filled in the cavity, wherein it comprises a filter disc fitted in the cavity between the beverage substance and the foil; the filter disc comprising:

- a frame comprising an annular reinforcing portion placed adjacent the circumferential wall of the cup and,
- a filter membrane of smaller thickness connected to the annular reinforcing portion;

wherein the frame comprises a plurality of transversal reinforcing portions separating the internal area demarcated by the annular reinforcing portion in a plurality of apertures open in the axial direction; and wherein the filter membrane covers the plurality of apertures; and, wherein the filter disc is positioned inside the capsule in a manner that the filter membrane is placed between the foil and the plurality of transversal reinforcing portions.

As a result, the filter membrane is less prone to damage while the filter disc remains rigid to reduce deformation and ensure a precise and easy positioning in the capsule even during brewing. The filling capacity in the capsule also remains optimal.

Preferably, the radial reinforcing portions forms radial spokes preferably merging in the axial centre of the disc. Such configuration is easy to produce and provides optimal rigidity.

The filter membrane is preferably adjacent the foil with a distance to the foil of less than 1.5 mm, more preferably less than 1.0 mm. By placing the filter membrane as close as possible to the foil, the deformation of the membrane is reduced and the filling capacity in the capsule is increased.

Preferably, the circumferential surface of the annular portion is flared towards the foil. This ensures a tightly fit with a truncated circumferential wall of the cup. This also provides a defined axial position of the filter disc in the cavity. Also, there is no need for providing an annular recess or step in the cup to fix the filter disc in position and which normally complicates the forming of the cup, especially, for aluminum-based cup that are typically formed from a flat foil, e.g. by deep drawing. Also, a truncated matching of the filter disc with the cup ensures a reduced risk of product by-pass due to the absence of corner.

In a mode, the filter membrane is sealed on one side to a planar surface of the annular reinforcing portion of the frame facing the foil. Preferably, the filter membrane comes flushed with the flange of the cup. Therefore, the filter membrane remains close to the foil and is well supported by the transversal reinforcing portions, e.g. radial spokes, in the interior of the cavity, when the foil is deformed and breaks against the extracting means of the brewing device.

The filling capacity of the capsule is also optimized with as less lost volume as possible.

In a second mode, the frame comprises:

- a base part comprising a first part of the transversal reinforcing portion with an inward annular step for holding the filter membrane and a plurality of transversal reinforcing portions and, a holding ring comprising a second part of the transversal reinforcing portion engaged against the filter membrane in the annular step of the base part for holding the filter in place.

The base part and the holding ring are preferably connected together such as by press-fitting and/or welding.

The rigidity of the filter disc is improved while maintaining the advantages of the previous mode. The connection of the filter membrane is improved and the filter membrane is less prone to disconnection during handling or storage. The handling of the filter disc is also facilitated for placing it in the capsule. The filter membrane is better protected against accidental perforation during handling.

In this mode, the holding ring can comprise secondary transversal reinforcing portions, e.g. secondary radial spokes, matching axially with the primary transversal reinforcing portions of the base part. In this case, the filter membrane is protected in both directions against axial deformation. The secondary transversal reinforcing portions also protects the filter membrane against mechanical or manual contact during handling.

The filter membrane is preferably pressed between the base part and the holding ring and/or welded to the base part and/or holding ring.

In general, the filter membrane is made of porous paper material, paper filter for example, or non-woven polymer material. The material can be polyurethane, polyamide, polyethylene, polypropylene and the like. The filter membrane may be made of biodegradable and/or compostable materials.

The frame can be made of injected polymer material. For example, the material for the frame can be polypropylene, polyethylene, polyamide, polystyrene and the like. Particularly, the frame may be made of biodegradable and/or compostable polymer materials.

Preferentially, the beverage substance is essentially roast-and-ground coffee powder. By "essentially", it is meant that the substance has at least 95% wt. of the defined material. The beverage substance may comprise roast and ground coffee powder and soluble coffee. The beverage substance may comprise green coffee, flavouring(s), sweetener(s), aroma oil(s), whitener(s) and combinations thereof. The beverage substance can also be essentially non-roast-and-ground coffee such soluble coffee, leaf tea, herbal tea, cocoa, chocolate, chicory, dairy milk, vegetal-origin milk and combinations thereof.

The invention further relates to a method for producing a capsule for the production of a beverage according to any of the preceding claims comprising the steps of:

providing a cup comprising a cavity defined by a circumferential wall, a bottom closing the circumferential wall at a first end, and an outwardly protruding flange connected to the circumferential wall at a second end in the axial direction of the capsule;

filling a beverage substance in the cavity;

placing the filter disc in the cavity on top of the beverage substance and by press fitting the frame in the cup with the annular surface of the frame placed adjacent the circumferential wall of the cup, sealing the foil on the flange of the cup for closing the capsule.

These and other aspects of the invention will be discussed in more detail with reference to like elements. It will be appreciated that the drawings are present for illustrative purposes and may not be used for limiting the scope of the appended claims.

BRIEF DESCRIPTION OF THE DRAWINGS

The invention will now be further described by means of, non-limiting examples referring to the drawings in which.

DETAILED DESCRIPTION OF THE DRAWINGS

Figure 11:
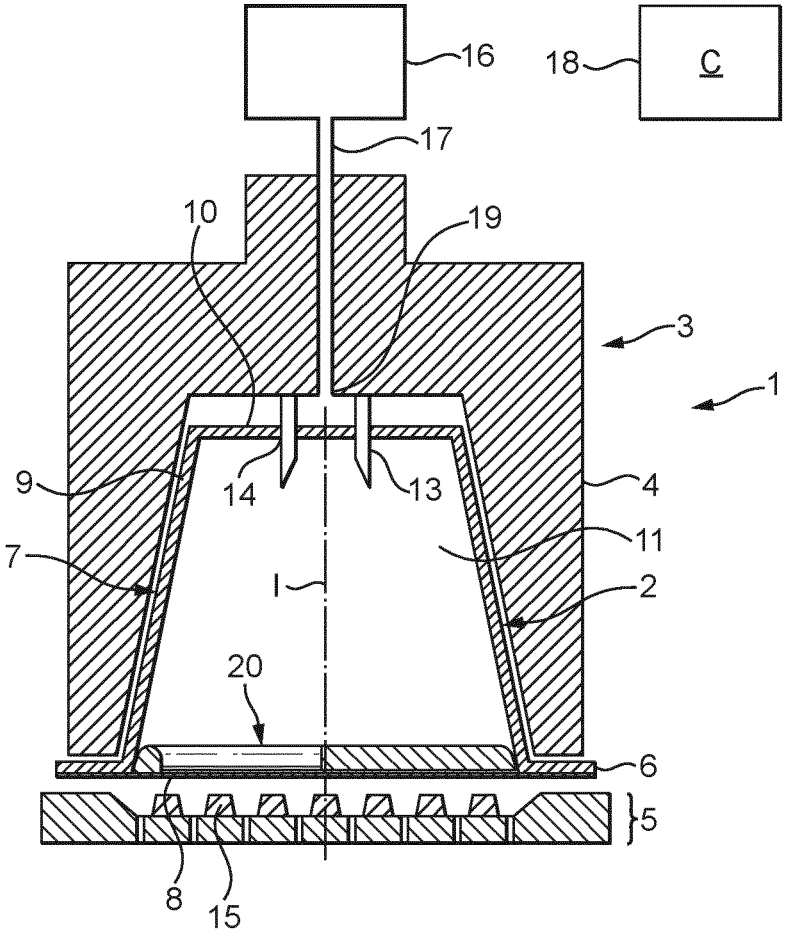
FIG. 11 is a schematic representation of a system of capsule and beverage brewing device of the present invention.

In the schematic representation of FIG. 11, in cross sectional view, a system for preparing a predetermined quantity of beverage suitable for consumption using a capsule of the invention is represented. The system 1 comprises a capsule 2 for producing a beverage using an extractable product, and a beverage brewing device 3. The device comprises a capsule cage 4 for receiving the capsule. The device further comprises a capsule support 5 for supporting the capsule. The capsule cage generally closes against an outwardly protruding flange 6 of the capsule which is, in turn pressed against an annular surface of the capsule support 5.

The capsule generally comprises a cup 7 extending by the flange 6 and a foil 8 connected to the flange, e.g. by welding. The cup comprises a circumferential wall 9 and a bottom wall 10 at a first end or inlet side of the capsule. The foil closes the second end or outlet side of the capsule. The circumferential wall extends revolutionary about a central axis I to form, for example, a slightly truncated wall. The bottom wall 10 may not necessary be transversally flat but may be outwardly convex, e.g., truncated. The cup and the foil 8 enclose an inner space forming a cavity 11 comprising the extractable product 12. In this example, the capsule is initially sealed, i.e., closed without openings prior to use.

In the device of FIG. 11, piercing means 13 are provided for piercing the bottom wall of the capsule for creating at least one entrance opening 14 in the bottom wall and for supplying liquid to the extractable substance through the entrance opening.

The device further comprises beverage extracting means 15, here embodied as protrusions of the support 5, for breaking (e.g. tearing or piercing) the foil of the capsule. The protrusions and lid can be arranged together for tearing the foil once a liquid pressure inside the cavity exceeds a threshold pressure and presses the foil 8 against the protrusions 15 with sufficient force. The foil may be a tearable foil. e.g., made of aluminum that is torn when contacting the protrusions 15.

In a non-represented embodiment, the foil may be peeled off before the use of the capsule, the peel off foil may comprise a tab to help removing the peel off foil. In this case, when water is injected inside the cavity of the capsule, no pressure is established inside the cavity and there is no contact with the protrusions 15 of the extraction device 1. The coffee thus obtained is a filter like coffee.

The device further comprises a source of liquid, e.g., a water reservoir 16 and a liquid circuit 17 that may comprise a heater and a pump (not shown) that are controlled by a control unit 18. The liquid circuit ends in the capsule cage by a liquid inlet 19 that is positioned closed to the piercing means 13 at the bottom side of the capsule. A one-way or check valve (not shown) may be provided to prevent liquid backflow in the circuit.

The capsule comprises a filter disc 20 that will be described in relation to the next figures.

The filter disc 20 is positioned inside the capsule, i.e., in the cavity 11, in manner that the disc is placed between the foil 8 and the beverage substance 12. When liquid flows in through the beverage substance, its path to the broken foil must necessarily cross the filter disc. By-pass of the disc by the liquid is prevented by ensuring tight fitting of the filter disc in the cup and, more preferably with the circumferential wall of the cup.

In view of FIGS. 1 to 5, the filter disc 20 preferably comprises a frame 21 that provides rigidity to the disc and a filter membrane 22 that ensures filtration of the liquid when passing from the cavity 11 to the opened foil during brewing. The frame 21 comprises an annular reinforcing portion 23 that is shaped and sized to tightly fit in the cup at a defined in-depth location. The annular reinforcing portion is designed to fix the filter disc as close as possible to the foil 8 while ensuring a proper protection of the filter membrane. The frame further comprises a plurality of transversal reinforcing portions 24 such as radial spokes. The transversal reinforcing portions or radial spokes extends transversally and separate the internal area demarcated by the annular reinforcing portion into a plurality of apertures 25. The apertures extends in the axial direction (I). The filter membrane is arranged to cover the plurality of apertures. The radial spoke can merge at the centre of the filter disc but other possible designs are possible.

The filter membrane 22 is placed preferably between the foil and the plurality of reinforcing portions or spokes. As a result, when the foil is broken by the device during brewing, the reinforcing portions provide rigidity to the filter membrane and particularly the inward deflection of the filter membrane is reduced by the reinforcing portions.

Figure 1:
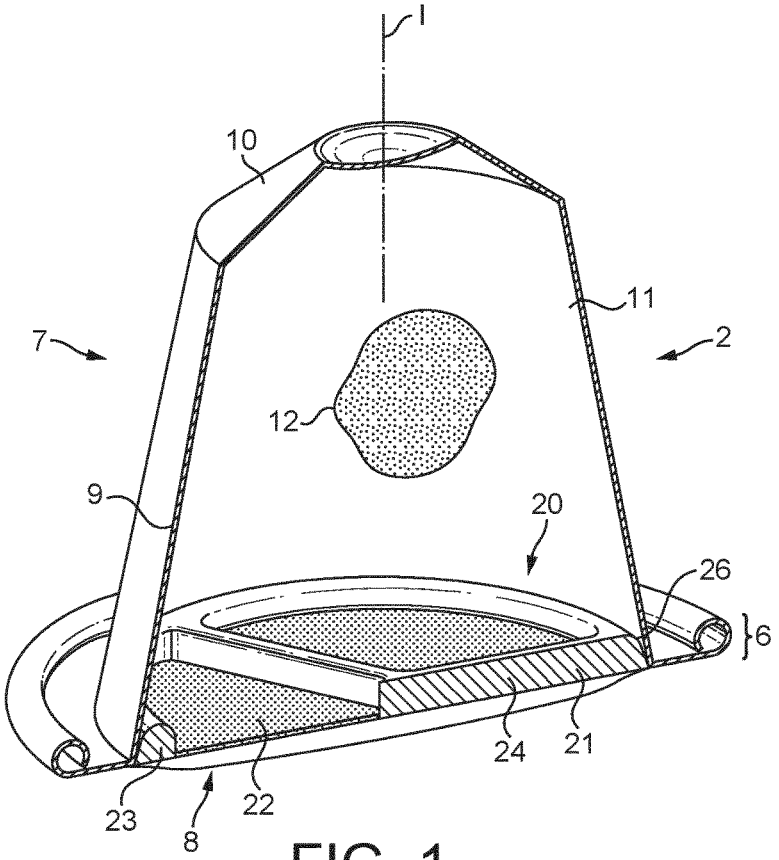
FIG. 1 shows a schematic representation in cross sectional perspective of a first embodiment of the capsule of the invention.
Figure 2:
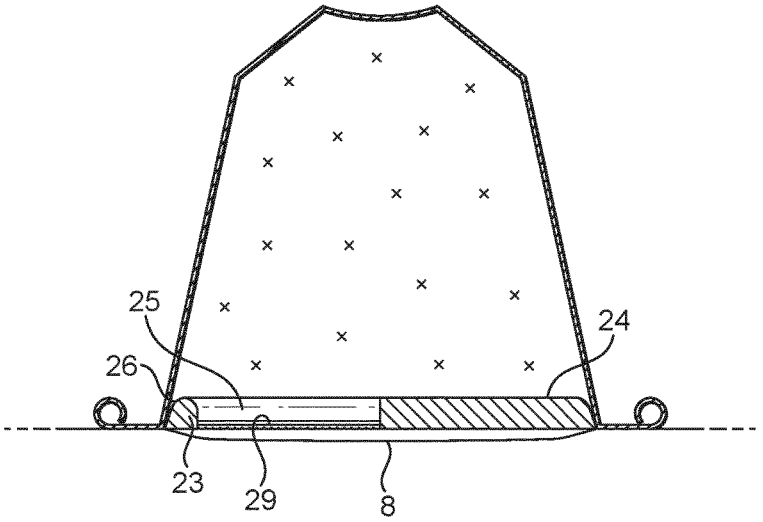
FIG. 2 shows a schematic representation in plane cross-section of the capsule of FIG. 1.
Figure 3:
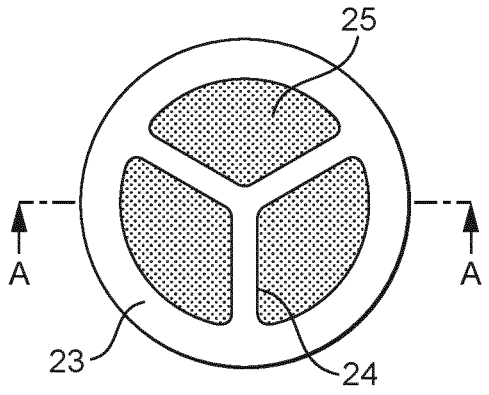
FIG. 3 shows a plane interior view of the filter disc of the capsule of FIGS. 1 and 2.
Figure 4:
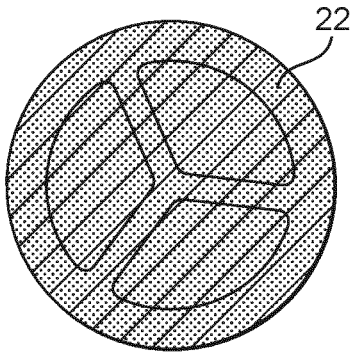
FIG. 4 shows a plane exterior view of the filter disc of the capsule of FIGS. 1 and 2.
Figure 5:
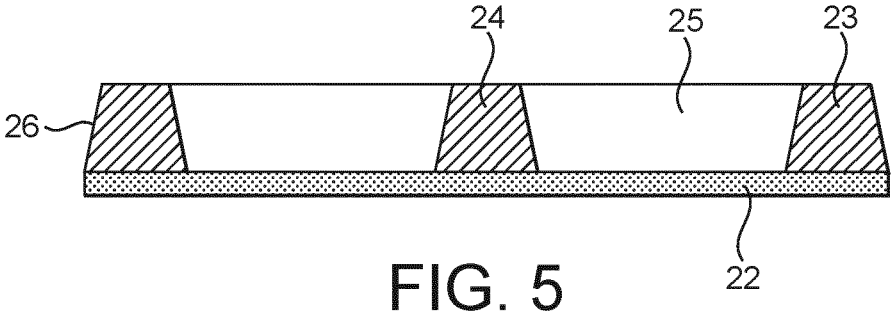
FIG. 5 is a cross-section view of the filter disc in direction A-A of the filter disc of FIG. 4.
Figure 6:
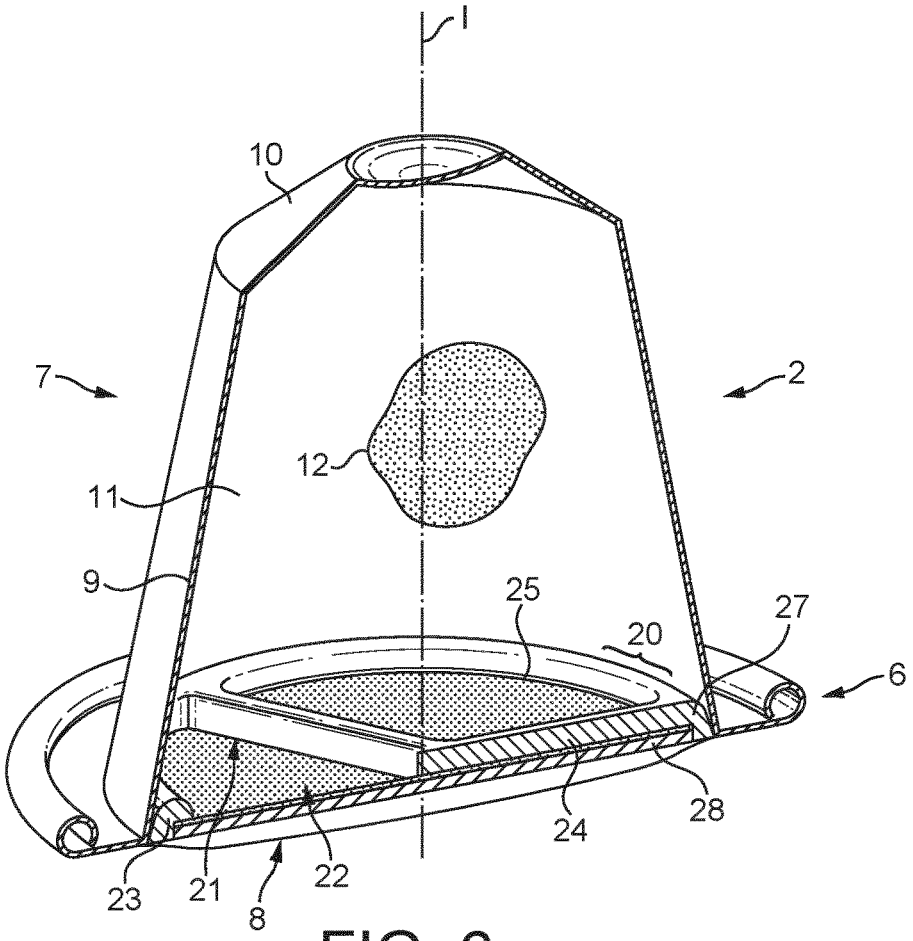
FIG. 6 shows a schematic representation in cross sectional perspective of a second embodiment of the capsule of the invention.
Figure 7:
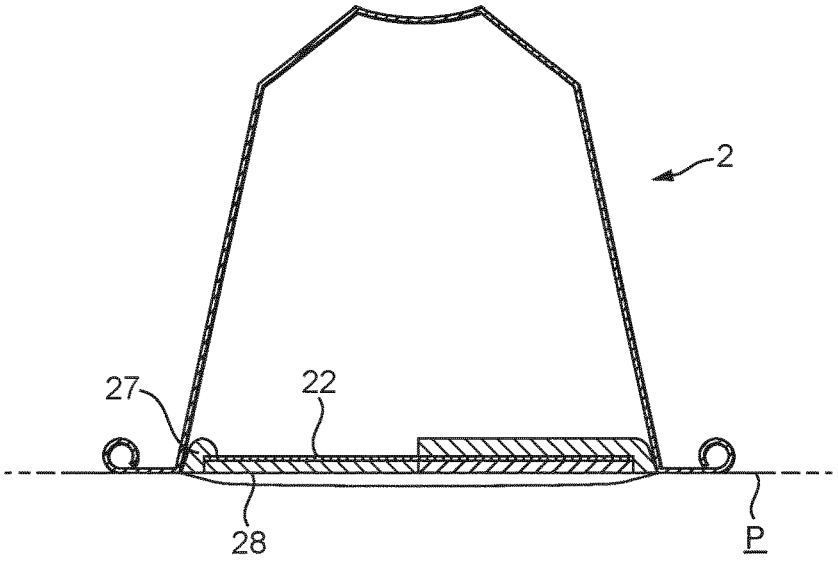
FIG. 7 shows a schematic representation in plane cross-section of the capsule of FIG. 6.
Figure 8:
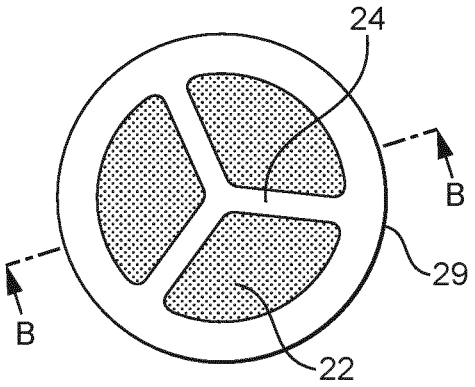
FIG. 8 shows a plane interior view (cavity side) of the filter disc of the capsule of FIGS. 6 and 7.
Figure 9:
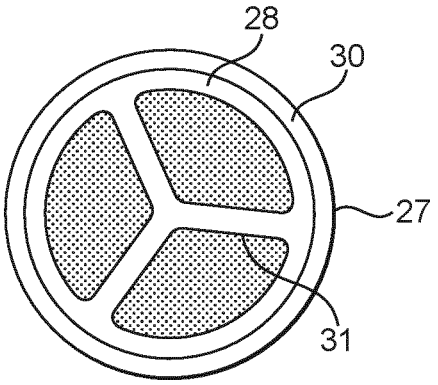
FIG. 9 shows a plane exterior view (foil side) of the filter disc of the capsule of FIGS. 7 and 8.
Figure 10:
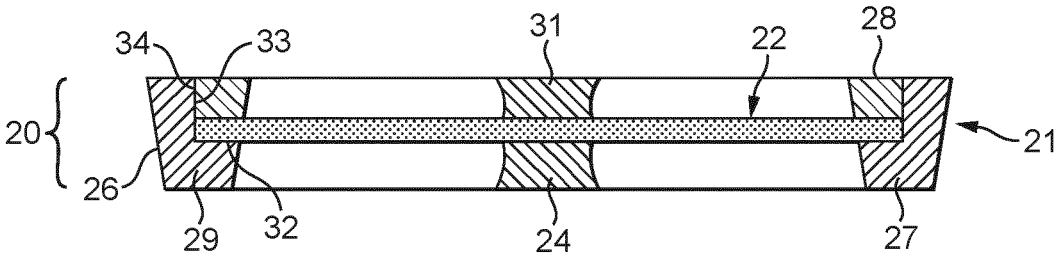
FIG. 10 is a cross-section view of the filter disc in direction B-B of the filter disc of FIG. 8.

A tight fit of the filter disc in the cup can be obtained by a flared design of the annular reinforcing portion 23. The annular reinforcing portion has a circumferential surface 26 which is flared towards the foil as illustrated by FIGS. 2 and 5. By dimensioning the annular portion properly, a tight fitting can be obtained with the circumferential wall which is complementarily truncated. No further connection is required such as adhesive or welding and the axial position of the filter disc is further secured by the compaction of the beverage substance and the foil placed adjacent the disc and welded to the flange.

In the mode of FIGS. 1-5, the filter membrane 22 can be welded or connected by other means such as adhesive to the wider surface (on the flared end) of the annular portion 23. It may further mere connected by welding or adhesive to the reinforcing portions 24.

A second mode of the invention is represented in FIGS. 6-10. In this mode, the filter differs in that the frame 21 is formed of two assembled parts 27, 28 that secures the filter membrane 22 in place and provides more rigidity to the disc thereby limiting the risk of the filter membrane to become distorted or damaged. The frame comprises a base part 27 comprising a first annular reinforcing portion 29 and a plurality of first transversal reinforcing portions 24, e.g. radial spokes and a holding ring 28 comprising a second annular reinforcing portion 30 and, optionally, a plurality of second transversal reinforcing portions 31, e.g., radial spokes.

The base part 27 may comprise an inward annular step 32 that holds the filter membrane in place, i.e., the periphery of the filter membrane fitting in the step. The holding ring 28 engages against the filter membrane 22 in the annular step 32 for holding or securing the filter membrane in place by preventing it from lifting up.

The holding ring 28 is preferably welded, clipped or clamped to the base part. In the case of the holding ring being welded to the based part, the holding ring comprises an outer surface 33 matching an inner circumferential surface 34 of the step; both surfaces 33, 34 being welded together such as by ultrasonic sealing or heat sealing.

The holding ring and base part are preferably made of the same polymer material or of different materials having welding compatibility together.

In this mode, the first annular reinforcing portion also comprises a circumferential surface 26 which is flared towards the foil when the filter disc is fitted in the capsule. The circumferential surface is dimensioned and shaped to tightly fit with the circumferential wall of the cup.

As previously described the frame 21 of the filter disc is preferably formed of injected rigid polymer such as polypropylene or polyamide. The filter membrane 22 can be made filter paper or a non-woven polymer material.

Both elements, frame and filter membrane may be made of biodegradable and/or compostable materials.

The invention claimed is:

1. A capsule for producing a beverage using an extractable product, by use of a beverage brewing device, the capsule comprising:

- a cup comprising a cavity defined by a circumferential wall, a bottom wall closing the circumferential wall at a first end, and an outwardly protruding flange connected to the circumferential wall at a second end opposite the first end in an axial direction of the capsule;
- a foil connected to the outwardly protruding flange and closing the cup at the second end,
- a beverage substance filled in the cavity,
- a filter disc fitted in the cavity between the beverage substance and the foil, the filter disc comprising:
  - a frame comprising an annular reinforcing portion placed adjacent the circumferential wall of the cup; and
  - a filter membrane of smaller thickness connected to or maintained by the annular reinforcing portion;
  - wherein the frame comprises a plurality of transversal reinforcing portions separating an internal area demarcated by the annular reinforcing portion in a plurality of apertures open in the axial direction; and
  - wherein the filter membrane covers the plurality of apertures;

the filter disc being positioned inside the capsule in a manner that the filter membrane is placed between the foil and the plurality of transversal reinforcing portions.

2. The capsule according to claim 1, wherein the plurality of transversal reinforcing portions form radial spokes.

3. The capsule according to claim 1, wherein the filter membrane is adjacent the foil with a distance to the foil of less than 1.5 mm.

4. The capsule according to claim 1, wherein a circumferential surface of the annular reinforcing portion is flared towards the foil to ensure a tight fit with the circumferential wall of the cup and to provide a defined axial position of the filter disc in the cavity, wherein the circumferential wall is truncated.

5. The capsule according to claim 1, wherein the filter membrane is sealed on one side to a planar surface of the annular reinforcing portion of the frame facing the foil.

6. The capsule according to claim 1, wherein the frame comprises:

a base part comprising a first part of the plurality of transversal reinforcing portions with an inward annular step for holding the filter membrane and the plurality of transversal reinforcing portions and, a holding ring comprising a second part of the plurality of transversal reinforcing portions engaged against the filter membrane in the annular step of the base part for holding the filter in place.

7. The capsule according to claim 6, wherein the holding ring comprises secondary transversal reinforcing portions.

8. The capsule according to claim 6, wherein the filter membrane is pressed between the base part and the holding ring or welded to the base part or the holding ring.

9. The capsule according to claim 1, wherein the filter membrane is made of porous paper material.

10. The capsule according to claim 1, wherein the frame is made of injected polymer material.

11. The capsule according to claim 1, wherein the filter membrane or the frame is made of biodegradable or compostable materials.

12. The capsule according to claim 1, wherein the beverage substance is essentially roast and ground coffee powder.

* * * * *